US009640876B2

(12) United States Patent
Schmidt et al.

(10) Patent No.: US 9,640,876 B2
(45) Date of Patent: May 2, 2017

(54) CRIMPED TERMINAL

(71) Applicant: Tyco Electronics AMP GmbH, Bensheim (DE)

(72) Inventors: Helge Schmidt, Speyer (DE); Christian Gregor, Zwingenberg (DE); Guido Van De Burgt, Bensheim (DE); Uwe Bluemmel, Hemsbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 12 days.

(21) Appl. No.: 14/246,398

(22) Filed: Apr. 7, 2014

(65) Prior Publication Data

US 2014/0220836 A1 Aug. 7, 2014

Related U.S. Application Data

(63) Continuation of application No. PCT/EP2012/069368, filed on Oct. 1, 2012.

(30) Foreign Application Priority Data

Oct. 7, 2011 (DE) ..... 10 2011 084 174

(51) Int. Cl.
*H01R 4/18* (2006.01)
*C22C 9/00* (2006.01)
(Continued)

(52) U.S. Cl.
CPC ..... *H01R 4/18* (2013.01); *C22C 9/00* (2013.01); *C22C 9/01* (2013.01); *C22C 9/02* (2013.01);
(Continued)

(58) Field of Classification Search
CPC .... H01R 13/5845; H01R 43/00; H01R 4/023; H01R 4/625
See application file for complete search history.

(56) References Cited

U.S. PATENT DOCUMENTS 2,869,103 A 1/1959 Wells
5,025,554 A * 6/1991 Dohi ..... H01R 4/187 174/94 R
(Continued)

FOREIGN PATENT DOCUMENTS

CH 351651 A 1/1961
DE 201221 A1 7/1983
(Continued)

OTHER PUBLICATIONS

PCT Notification and International Preliminary Report on Patentability, App. No. PCT/EP2012/069368, dated Apr. 8, 2014, 10 pages.
(Continued)

*Primary Examiner* — Truc Nguyen
(74) *Attorney, Agent, or Firm* — Barley Snyder

(57) ABSTRACT

A crimped terminal is provided and includes a conductor, a crimped element, and a plurality of conductive particles: The conductor includes aluminum, and the crimped element is disposed around the conductor. The plurality of conductive particles include a copper alloy and are arranged between the conductor and the crimped element.

22 Claims, 1 Drawing Sheet

(51) Int. Cl.

| | |
|---|---|
| ***C22C 9/01*** | (2006.01) |
| ***C22C 9/02*** | (2006.01) |
| ***C22C 9/04*** | (2006.01) |
| ***C22C 9/06*** | (2006.01) |
| ***C22C 21/00*** | (2006.01) |
| ***H01R 4/62*** | (2006.01) |
| ***H01R 43/048*** | (2006.01) |
| ***H01R 13/03*** | (2006.01) |

(52) U.S. Cl.
CPC ..... *C22C 9/04* (2013.01); *C22C 9/06* (2013.01); *C22C 21/00* (2013.01); *H01R 4/185* (2013.01); *H01R 4/62* (2013.01); *H01R 13/03* (2013.01); *H01R 43/048* (2013.01); *Y10T 29/49218* (2015.01)

(56) References Cited

U.S. PATENT DOCUMENTS

| | | | | |
|---|---|---|---|---|
| 7,282,679 | B2 * | 10/2007 | Reichinger | H01R 4/62 174/84 C |
| 7,306,469 | B1 * | 12/2007 | Slautterback | H01R 13/633 439/593 |
| 2010/0018768 | A1 * | 1/2010 | Takahashi | H01R 4/183 174/74 R |
| 2010/0291399 | A1 | 11/2010 | Kato et al. | |
| 2013/0070275 | A1 * | 3/2013 | Kawashima | H04N 1/00474 358/1.13 |
| 2013/0217279 | A1 * | 8/2013 | Hemond | H01R 4/188 439/878 |
| 2013/0273787 | A1 * | 10/2013 | Mitose | H01R 4/185 439/878 |

FOREIGN PATENT DOCUMENTS

| | | | | |
|---|---|---|---|---|
| DE | 208015 | A1 | 3/1984 | |
| EP | 0018863 | A1 | 11/1980 | |
| JP | 08321330 | A | 3/1996 | |
| JP | 08321331 | A | 3/1996 | |
| JP | 08321332 | A | 3/1996 | |
| JP | 08321331 | * | 12/1996 | H01R 4/18 |
| JP | 08321332 | * | 12/1996 | H01R 4/18 |
| JP | 2003243058 | A | 8/2003 | |
| JP | 2010044995 | A | 2/2010 | |
| WO | 2009139469 | A1 | 11/2009 | |
| WO | 2009142277 | A1 | 11/2009 | |

OTHER PUBLICATIONS

PCT International Search Report and Written Opinion, International Application No. PCT/EP2012/069368, dated Nov. 21, 2013, 17 pages.

The First Office Action, Chinese Patent Application No. 2012800492838, issued Sep. 21, 2015, 8 pages.

* cited by examiner

CRIMPED TERMINAL

CROSS-REFERENCE TO RELATED APPLICATIONS

This application is a continuation of PCT International Application No. PCT/EP2012/069368 filed Oct. 1, 2012, which claims priority under 35 U.S.C. §119 to DE 10 2011 084 174.1, filed Oct. 7, 2011.

FIELD OF THE INVENTION

The invention relates to a terminal and, in particular, to a crimped terminal connection.

BACKGROUND

There are known various types of crimped terminal connections in which an electrically conductive crimped element, generally a crimped sleeve, is connected to an conductor in a mechanical and electrically conductive manner. The conductor generally has a plurality of conductor wires. A significant function of the crimped connection is to produce a low electrical resistance between the crimped element and the conductor.

SUMMARY

A crimped terminal is provided and includes a conductor, a crimped element, and a plurality of conductive particles: The conductor includes aluminium, and the crimped element is disposed around the conductor. The plurality of conductive particles include a copper alloy and are arranged between the conductor and the crimped element.

BRIEF DESCRIPTION OF THE DRAWINGS

The invention is explained in greater detail below with reference to embodiments with reference to the appended drawings. In the detailed Figures.

DETAILED DESCRIPTION OF THE EMBODIMENT(S)

The invention is explained in greater detail below with reference to the Figures.

Figure 1:
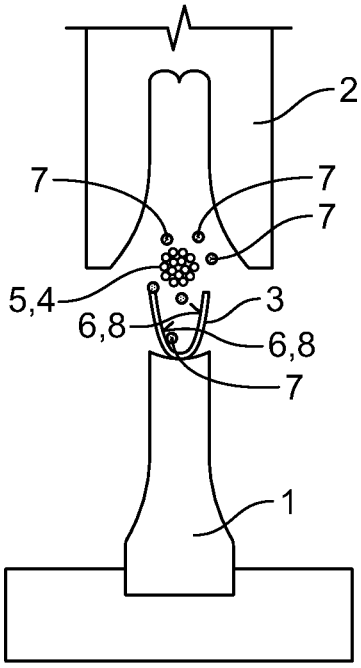
FIG. 1 is a schematic diagram of a crimped terminal according to the invention, prior to crimping by a crimping tool.

As shown in FIG. 1, a crimping tool includes an anvil 1 and a stamp 2. A crimped element 3 is arranged on the anvil 1. Above the crimped element 3, an electrical conductor 4 is provided and includes a plurality of conductor wires 5, referred to as strands. Conductive particles 7 are applied to the conductor 4 and/or to a contact side 6 of the crimped element 3.

In another embodiment, the conductive particles 7 are at least partially produced from an electrically conductive metal, in particular at least partially from copper. For example, the particles comprise brass, the zinc content preferably being between 10 and 70%.

As ternary copper alloys for conductive particles, it is possible to use compounds of copper and zinc with one other element from the following group: tin, aluminium, iron, nickel, silver, titanium, magnesium or chromium.

In an embodiment, a crimped element 3 may be surrounded by a zinc layer. The zinc layer brings about shielding of the conductor from the oxygen in the air in the region of the mechanical connection of the electrical particle and the conductor and a shielding of the mechanical connection of the particle and the crimped element. The long-term stability of the electrically conductive connection between the conductor and the crimped element is thereby improved.

The conductive particles are, for example, at least partially produced from one of the following copper alloys: CuSn, CuFe, CuNiSi, CuAl+XY.

The crimped element 3 is produced from an electrically conductive material, for example, a metal. Depending on the embodiment selected, the crimped element 3 is provided with a tin layer 8 at least on the contact side 6.

The crimped element 3 and/or the conductor 4 may be produced, for example, from one of the following materials: Cu, CuSn, CuZn, CuZnSn, CuFe, CuNiSi, CuNiZn.

Depending on the embodiment selected, the conductor is produced from aluminium or an aluminium alloy having an aluminium content of >90%, a plurality of conductor strands 5 preferably being provided as a conductor 4.

Tests have shown that the conductive particles 7 may have a diameter which is smaller than 100 μm, in particular smaller than 60 μm. The conductive particles 7 have a size such that their diameter is smaller than 60 μm and preferably greater than 10 μm. Owing to the orders of magnitude selected, the conductive particles 7 are particularly suitable for producing an electrically conductive connection between the crimped element 3 and the conductor 4, without impairing the crimping operation or damaging the crimped element 3 and/or the conductor 4.

In an embodiment of the invention, the conductive particles 7 may have a diameter which is not greater than from 5 to 30% of the diameter of a single strand 5, or in the range from 5 to 20% of the diameter of the individual strand. With the conventional orders of magnitude of the conductor strands 5, this corresponds approximately to a diameter which is between 10 and 100 μm, or between 10 and 60 μm.

The conductive particles 7 may be produced by means of mechanical comminution as a powder. During the mechanical comminution, the particles are provided with edges which enable an improvement of the mechanical and electrical contacts between the crimped element 3 and the conductor 4.

Depending on the embodiment selected, conductive particles 7 which have a spherical surface can also be used.

The conductive particles 7 are, for example, applied to the conductor 4 and/or to the contact side 6 of the crimped element 3 using air flow. In addition, the application of the conductive particles 7 can also be carried out using a brush or a stamp process. Furthermore, it is possible to use a carrier agent into which the conductive particles are introduced. Organic solvents, such as, for example, benzene, alcohol, acetone, oils, etc., are, for example, suitable as carrier agents. In addition, the particles can be introduced with or without the organic solvent into a fat which is then applied to the conductor 4 or the contact side 6 in a layered manner. The layering can be applied by means of spraying or dispensing methods, such as, for example, ink jet or micro-dispensing.

Since the tin layer 8 is disposed on the crimped element 3, an inter-metallic contact face of the conductive particle 7 is shielded with respect to the metal of the conductor or the metal of the crimped element so that little or no oxygen reaches the inter-metallic contact face. Any oxygen introduced is first bound by the tin layer which oxidises to form tin oxide. Consequently, the oxygen is kept away from the inter-metallic contact face between the conductive particles 7 and the conductor or the conductive particle 7 and the crimped element 3.

After the conductive particles 7 are introduced, the stamp 2 is pressed in the direction towards the anvil 1. In this instance, the stamp 2 presses the conductor 4 into the crimped element 3 and engages crimped flanks of the crimped element 3. The crimped flanks are rolled in, the conductor is uniformly compressed and the crimped connection formed. The particles are pressed both into the contact side 6 of the crimped element 3 and the surfaces of the conductor 4 as a result of the pressure.

Figure 2:
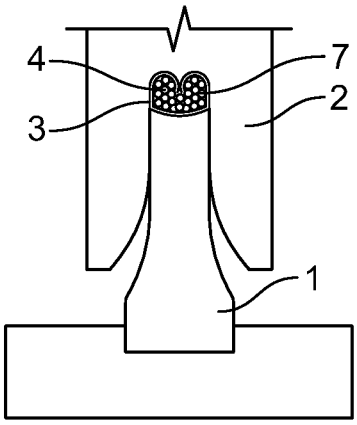
FIG. 2 is a schematic diagram of a crimped terminal according to the invention, after crimping has occurred by the crimping tool.

As shown in FIG. 2, the conductor 4 is pressed with the crimped element 3 and the conductive particles 7.

Figure 3:
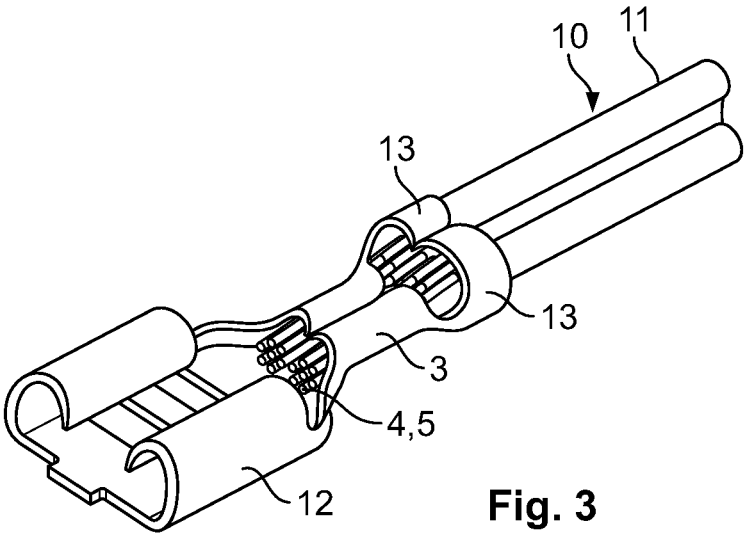
FIG. 3 is a perspective view of the a crimped terminal according to the invention.

As shown in FIG. 3, an electrical line 10 includes an conductor 4 in the form of a plurality of strands 5. The conductor 4 is surrounded by an electrically insulating cover 11. The crimped element 3 is attached to ends of the strands 5 from which insulation has been removed. The crimped element 3 has a contact element 12 which may be fitted with a connecting contact. In addition, the crimped element 3 has additional flanks 13 which are pressed with the cover 11 as tensile relief.

The foregoing illustrates some of the possibilities for practicing the invention. Many other embodiments are possible within the scope and spirit of the invention. The reports shown in the specification are merely exemplary embodiments and the spirit of the invention incorporates a custom report having the details listed above. It is, therefore, intended that the foregoing description be regarded as illustrative rather than limiting, and that the scope of the invention is given by the appended claims together with their full range of equivalents.

What is claimed is:

1. A crimped terminal, comprising:

a conductor containing aluminum;

a crimped element disposed around the conductor; and a plurality of comminuted conductive particles having a copper alloy, the plurality of conductive particles disposed in a carrier agent and applied to the conductor and a contact side of the crimped element.

2. The crimped terminal, according to claim 1, wherein the plurality of conductive particles have a diameter of less than 100 μm.

3. The crimped terminal according to claim 2, wherein the diameter of the plurality of conductive particles is less than 60 μm.

4. The crimped terminal according to claim 3, wherein the diameter of the plurality of conductive particles is greater than 10 μm.

5. The crimped terminal, according to claim 1, wherein the plurality of conductive particles are formed from a mechanically comminuted powder.

6. The crimped terminal, according to claim 1, wherein the plurality of conductive particles include edges.

7. The crimped terminal, according to claim 1, wherein the plurality of conductive particles include one of the following copper alloys: CuSn, $CuZn_xSn_y$, CuFe, CuNiSi, $CuAl_{xy}$.

8. The crimped terminal, according to claim 1, wherein the plurality of conductive particles include a ternary compound of copper and zinc.

9. The crimped terminal, according to claim 8, wherein the plurality of conductive particles include an additional element from the following group: Sn, Al, Fe, Ni, Ag, Ti, Mg or Cr.

10. The crimped terminal, according to claim 1, wherein the plurality of conductive particles include a zinc content between 10% and 70%.

11. The crimped terminal, according to claim 1, wherein the crimped element is surrounded by a tin layer.

12. The crimped terminal, according to claim 1, wherein the conductor includes an aluminum alloy comprising >90% of aluminum.

13. The crimped terminal, according to claim 1, wherein the crimped element includes one of the following materials: Cu, CuSn, CuZn, CuZnSn, CuFe, CuNiSi, CuNiZn.

14. The crimped terminal, according to claim 1, wherein the carrier agent is an organic solvent.

15. The crimped terminal, according to claim 14, wherein the organic solvent is a benzene.

16. The crimped terminal, according to claim 14, wherein the organic solvent is an alcohol.

17. The crimped terminal, according to claim 14, wherein the organic solvent is an acetone.

18. The crimped terminal, according to claim 14, wherein the organic solvent is a fat.

19. A method for producing a crimped connection between a crimped element and an electrical conductor comprising the steps of:

introducing electrically conductive particles into a carrier agent;

applying the carrier agent having the electrically conductive particles between the conductor and the crimped element; and crimping the crimped element to the conductor.

20. The method according to claim 19, wherein the carrier agent is an organic solvent or a fat.

21. The method according to claim 19, wherein the electrically conductive particles are comminuted conductive particles.

22. A crimped terminal, comprising:

a conductor containing aluminum;

a crimped element disposed around the conductor; and a plurality of spherical conductive particles disposed in a carrier agent and arranged between the conductor and a contact side the crimped element.

* * * * *